US006563068B2

(12) United States Patent
Yamagata et al.

(10) Patent No.: US 6,563,068 B2
(45) Date of Patent: May 13, 2003

(54) DOME-SHAPED CONTACT PLATE GIVING CRISPY FEELING OF CLICK AND SHEET WITH CONTACT PLATE

(75) Inventors: Takeo Yamagata, Miyagi-ken (JP); Katsuaki Shimatani, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/043,909

(22) Filed: Jan. 11, 2002

(65) Prior Publication Data

US 2002/0096425 A1 Jul. 25, 2002

(30) Foreign Application Priority Data

Jan. 18, 2001 (JP) ..... 2001-010782

(51) Int. Cl.[7] ..... H01H 5/30

(52) U.S. Cl. ..... 200/406; 200/516

(58) Field of Search ..... 200/406, 512, 200/516, 520, 341

(56) References Cited

U.S. PATENT DOCUMENTS

| | | | | | |
|---|---|---|---|---|---|
| 4,254,309 | A | * | 3/1981 | Johnson | 200/5 A |
| 4,343,973 | A | * | 8/1982 | Main | 200/516 |
| 4,933,522 | A | * | 6/1990 | Celander | 200/513 |
| 5,845,766 | A | * | 12/1998 | Sako et al. | 200/516 |
| 5,924,555 | A | | 7/1999 | Sadamori et al. | 200/512 |
| 5,986,228 | A | * | 11/1999 | Okamoto et al. | 200/516 |
| 6,259,046 | B1 | * | 7/2001 | Iwama et al. | 200/5 A |
| 6,271,491 | B1 | * | 8/2001 | Ono et al. | 200/520 |

* cited by examiner

*Primary Examiner*—Michael Friedhofer
(74) *Attorney, Agent, or Firm*—Beyer Weaver & Thomas

(57) ABSTRACT

A movable contact structure which, even when used in a planar circuit board, can provide a crispy click feeling and will not fail to return to an original position after being inverted is to be provided. The structure consists of a disc formed into a dome shape by cupping a center of a thin metallic sheet in one direction, provided with a skirt rising at a prescribed angle from an outer circumference of this disc toward a center of the disc, and a dome which is continuous from this skirt and can be repetitively inverted, the connecting part between the skirt and the dome being formed in multiple steps via a plurality of bent portions.

8 Claims, 6 Drawing Sheets

DOME-SHAPED CONTACT PLATE GIVING CRISPY FEELING OF CLICK AND SHEET WITH CONTACT PLATE

BACKGROUND OF THE INVENTION

1. Field of the Invention

The present invention relates to a contact plate for use as a movable contact of a push-button switch, and more particularly to a disc contact plate press-formed into a dome shape, a sheet with the contact plate, and the structure of a switch device using the sheet.

2. Description of the Prior Art

Known structures of a contact plate for use as the movable contact of a push-button switch include the structures illustrated in FIG. 8 through FIG. 12. FIG. 8 through FIG. 10 are sectional views showing the relationship between a movable contact and a fixed contact, and FIGS. 11 and 12 illustrate the relationship between the manipulative force on and the shifted quantity of the movable contact.

FIG. 8 shows a state in which a disc movable contact 51 formed by cupping a thin metallic sheet into a dome shape is mounted over a central fixed contact 53 and a peripheral fixed contact 54, each similarly consisting of an electroconductive metallic sheet, arranged on the inner bottom face of a housing 52 consisting of synthetic resin or the like.

The movable contact 51 is formed of a skirt 51*a* rising from the outer circumference of a disc at a prescribed angle toward the center of the disc and a dome 51*b*, which is continuous from the skirt 51*a* and can be repetitively inverted. The skirt 51*a* and dome 51*b* are connected to each other by a smooth bend 51*c*. An outer peripheral end 51*d* of the skirt 51*a* is in contact with the peripheral fixed contact 54 at all times, and the inside of the top of the dome 51*b* constitutes a contact 51*e*, which comes into contact with the central fixed contact 53 when the dome 51*b* is repetitively inverted.

A gap is formed between the central fixed contact 53 and the peripheral fixed contact 54, with the central fixed contact 53 being formed a step below the peripheral fixed contact 54. As indicated by curve A in FIG. 11, when the dome 51*b* of the movable contact 51 is inverted the distance (shifted quantity) L1 between the contact 51*e* and the central fixed contact 53 can be greater by the level difference of the step, thus the shifted quantity after the inversion of the movable contact 51*b* can be set greater than otherwise, resulting in a crispy feeling of click. In the diagram the vertical axis represents the manipulative force F, and the horizontal axis represents the shifted quantity L.

Incidentally, AO in the diagram denotes the tactile sensation (click feeling) curve of the movable contact 51 and LA denotes the point where the reaction force after the inversion of the movable contact 51 is at its minimum, i.e., the settable maximum of the shifted quantity.

FIG. 9 illustrates a state in which the movable contact 51 is mounted over a circuit board 55 on which a circuit pattern is formed of a copper foil or the like. In this case, since a central fixed contact 56 and a peripheral fixed contact 57 are formed of a copper foil or the like in a planar form over the circuit board 55, the distance (the shifted quantity) L2 between the contact 5Se and the central fixed contact 56 is less than L1 when the dome 51*b* of the movable contact 51 is inverted.

FIG. 10 shows a movable contact 58 formed in a state in which the rising angle θc of a skirt 58*a* is set more nearly upright than θb shown in FIG. 9 (θb<θc) so that when the dome 58*b* of the movable contact 58 is inverted the distance (the shifted quantity) L3 between a contact 58*e* and the central fixed contact 56 becomes equal to L1 (L3=L1). As indicated by curve C in FIG. 12, when the dome 58*b* of the movable contact 58 is inverted, the distance (the shifted quantity) L3 between the contact 58*e* and the central fixed contact 56 can be greater, the shifted quantity after the inversion of the movable contact 58 can be set greater than otherwise, resulting in a crispy feeling of click.

However, in the above-described structure of the movable contact 51 according to the prior art, when it is to be used in the planar circuit board 55 and when the dome 51*b* of the movable contact 51 is inverted, the distance (the shifted quantity) L2 between the contact 51*e* and the central fixed contact 56 is less than L1. The shifted quantity thus becomes smaller after the inversion of the movable contact 51 as indicated by B in FIG. 11, resulting in a problem of a dull feeling of click.

Further, if the rising angle θc of the skirt 58*a* is increased, the reaction force of the tactile sensation curve CO of the movable contact 58 will take on a negative value at point LC as shown in FIG. 12, resulting in a problem that the movable contact 58 remains inverted instead of automatically returning to the original state.

SUMMARY OF THE INVENTION

An object of the present invention, therefore, is to solve the problems noted above and provide a movable contact structure which, even when used in a planar circuit board, can provide a crispy click feeling and will not fail to return to an original position after being inverted.

In order to solve the problems noted above, according to a first aspect of the invention, there is provided a contact plate consisting of a disc formed into a dome shape by cupping a center of a thin metallic sheet in one direction, provided with a skirt rising at a prescribed angle from an outer circumference of this disc toward a center of the disc, and a dome which is continuous from this skirt and can be repetitively inverted, the connecting part between the skirt and the dome being formed in multiple steps via a plurality of bent portions.

According to a second aspect of the invention, a projection in contact with a fixed contact is formed on an inner face of the dome.

According to a third aspect of the invention, an external face of the dome of the contact plate according to the first or second aspect of the invention is stuck to an adhesive back face layer of an insulating sheet, and the contact plate and an lower face of the insulating sheet are covered with a peelable protective sheet.

According to a fourth aspect of the invention, a spacer sheet having an accommodating hole for accommodating the contact plate is provided between the insulating sheet and the protective sheet.

According to a fifth aspect of the invention, the protective sheet of the sheet with the contact plate according to the third or fourth aspect of the invention is peeled, and the sheet with the contact plate after peeling is stuck to a circuit board, over which a plurality of fixed contacts are arranged, by the adhesive back face layer of the insulating sheet so that the contact plate is opposite the fixed contacts.

According to a sixth aspect of the invention, there is provided a switch device having the contact plate according to the first or second aspect of the invention and an accommodating section, whose inner bottom face is provided with a housing over which a fixed contact is arranged and a suppressing member liftably snapped into the accommodating section, wherein the contact plate is arranged opposite the fixed contact to be suppressible by the suppressing member.

DETAILED DESCRIPTION OF THE PREFERRED EMBODIMENTS

Figure 1:
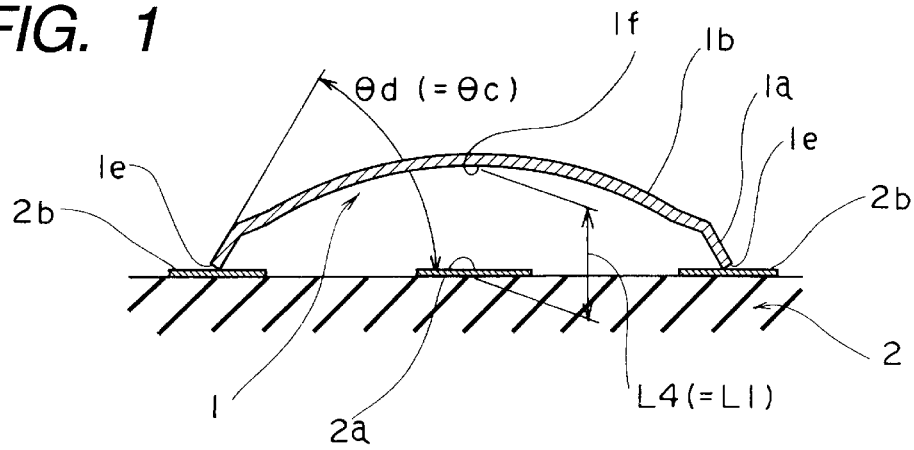
FIG. 1 is a sectional view showing the relationship between a movable contact, which is a preferred embodiment of the present invention, and a fixed contact.
Figure 2:
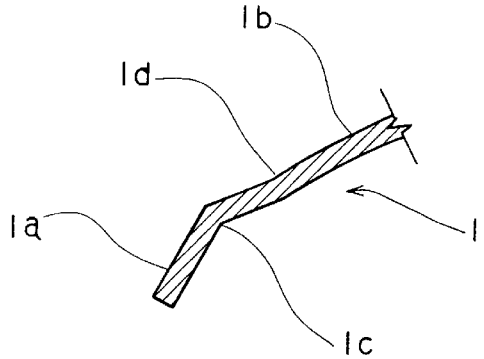
FIG. 2 is a partial sectional view illustrating the connection section between the skirt and the dome of the movable contact embodying the invention.
Figure 3:
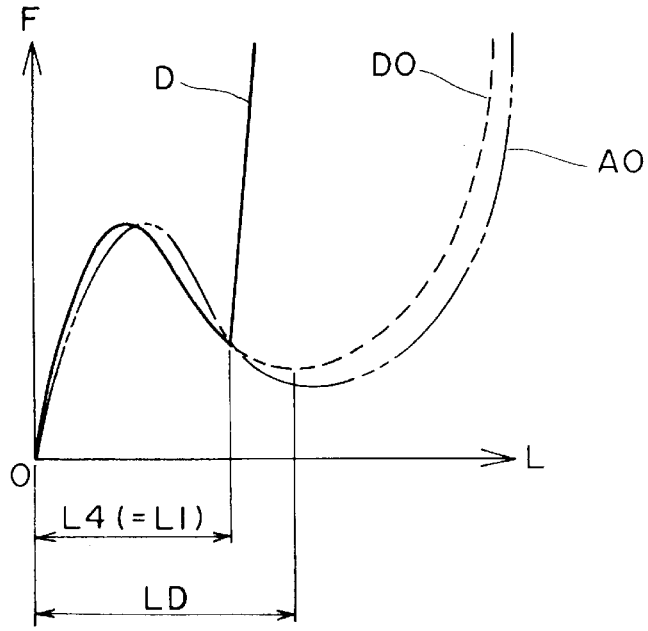
FIG. 3 illustrates the relationship between the manipulative force on and the shifted quantity of the movable contact embodying the invention.

A preferred embodiment of the present invention will be described below with reference to FIG. 1 through FIG. 3. FIG. 1 is a sectional view illustrating the relationship between a movable contact and a fixed contact; FIG. 2 is a partial sectional view illustrating the connection section between the skirt and the dome of the movable contact; and FIG. 3 illustrates the relationship between the manipulative force on and the shifted quantity of the movable contact.

Referring to FIG. 1, a movable contact 1 is a thin metallic plate formed in a disc shape. This movable contact 1 is composed of a skirt 1*a* rising from the outer circumference of the disc at a prescribed angle toward the center of the disc and a dome 1*b*, which is continuous from this skirt 1*a* and can be repetitively inverted, and the skirt 1*a* and dome 1*b* are formed in multiple steps via a plurality of bent portions 1*c* and 1*d* (two portions in this embodiment).

A circuit board 2 consists of an insulating planar laminate, and over its surface are formed a central fixed contact 2*a*, and a peripheral fixed contact 2*b* of an electroconductive circuit pattern made of a copper foil or the like.

The movable contact 1 is mounted to be opposite the central fixed contact 2*a* and the peripheral fixed contact 2*b*, and the outer peripheral end 1*e* of the skirt 1*a* is in contact with the peripheral fixed contact 2*b* all the time, and the inner face of the top of the dome 1*b* constitutes the contact 1*f*, which goes out of contact with the central fixed contact 2*a* when the dome is repetitively inverted.

Figure 9:
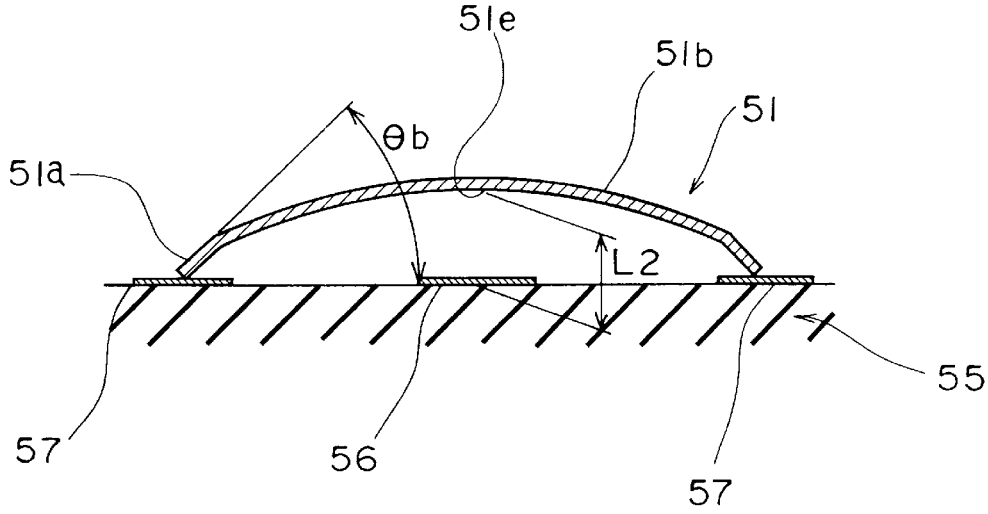
FIG. 9 PRIOR ART
FIG. 9 is a sectional view showing another example of the relationship between a movable contact and a fixed contact according to the prior art.
Figure 10:
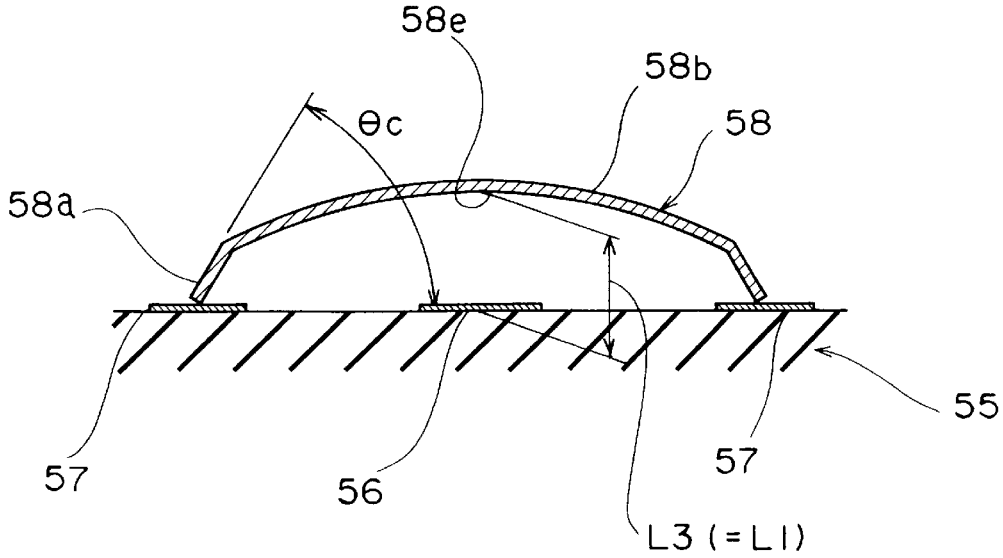
FIG. 10 PRIOR ART
FIG. 10 is a sectional view showing still another example of the relationship between a movable contact and a fixed contact according to the prior art.

In one embodiment, the rising angle θd of the skirt 1*a* of the movable contact 1 is formed to be more nearly upright than θb according to the prior art shown in FIG. 9 (θb<θd), and this θd is formed to be equal to θc according to the prior art shown in FIG. 10 (θc=θd).

Thus, the configuration is such that when the dome 1*b* of the movable contact 1 is inverted the distance (shifted quantity) L4 between the contact 1*f* and the central fixed contact 2*a* becomes equal to L1 (L4=L1) and, as the distance (the shifted quantity) L4 between the contact 1*f*and the central fixed contact 2*a* when the dome 1*b* of the movable contact 1 is inverted is greater, the shifted quantity after the inversion of the movable contact 1 can be set greater than otherwise as indicated by D in FIG. 3, resulting in a crispy feeling of click. In the diagram the vertical axis represents the manipulative force F, and the horizontal axis, the shifted quantity L.

Figure 11:
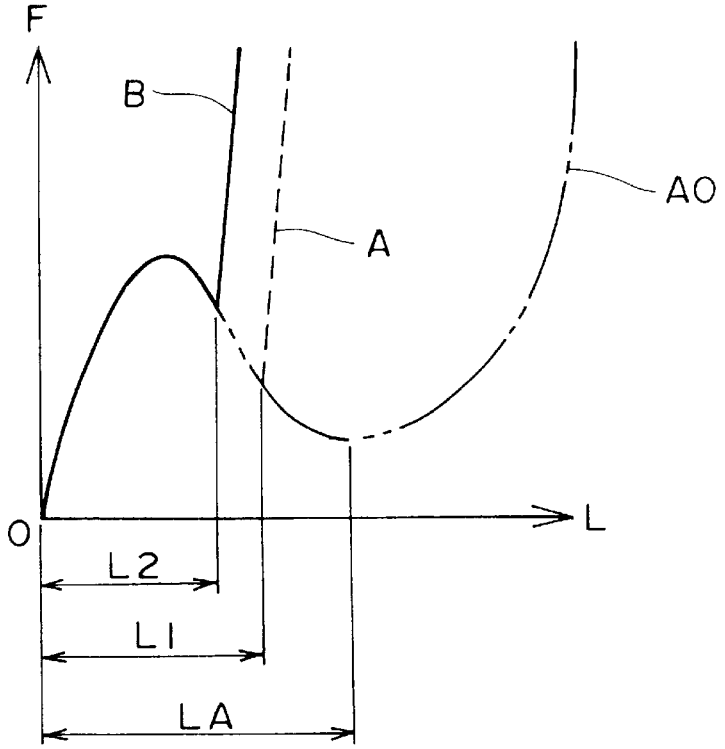
FIG. 11 PRIOR ART
FIG. 11 illustrates an example of the relationship between the manipulative force on and the shifted quantity of the movable contact according to the prior art.
Figure 12:
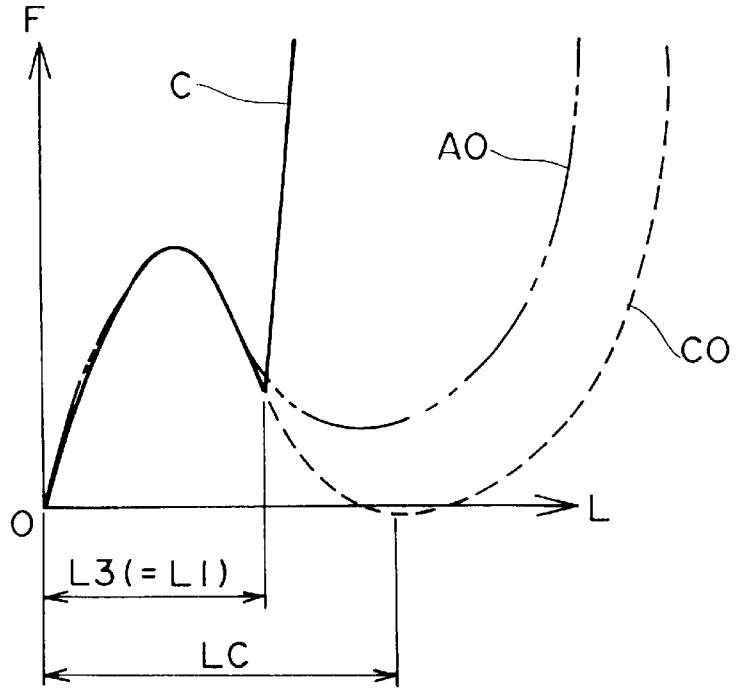
FIG. 12 PRIOR ART
FIG. 12 illustrates another example of the relationship between the manipulative force on and the shifted quantity of the movable contact according to the prior art.

Further, while the rising angle θd of the skirt 1*a* of the movable contact 1 is formed more nearly upright, the connecting part of the dome 1*b* to be connected to this skirt 1*a* is connected via the two bent portions 1*c* and 1*d*, and it is possible to generally reduce the angle formed by the bent portion 1*d* of the bent portions with the dome 1*b*. Accordingly, the tactile sensation curve DO formed when the dome 1*b* is inverted can be brought close to the tactile sensation curve AO according to the prior art shown in FIGS. 11 and 12, with the result that the point LD, where the reaction force of the tactile sensation curve DO reaches its minimum, never becomes negative and the movable contact 1 can automatically return to its original position without fail.

Figure 4:
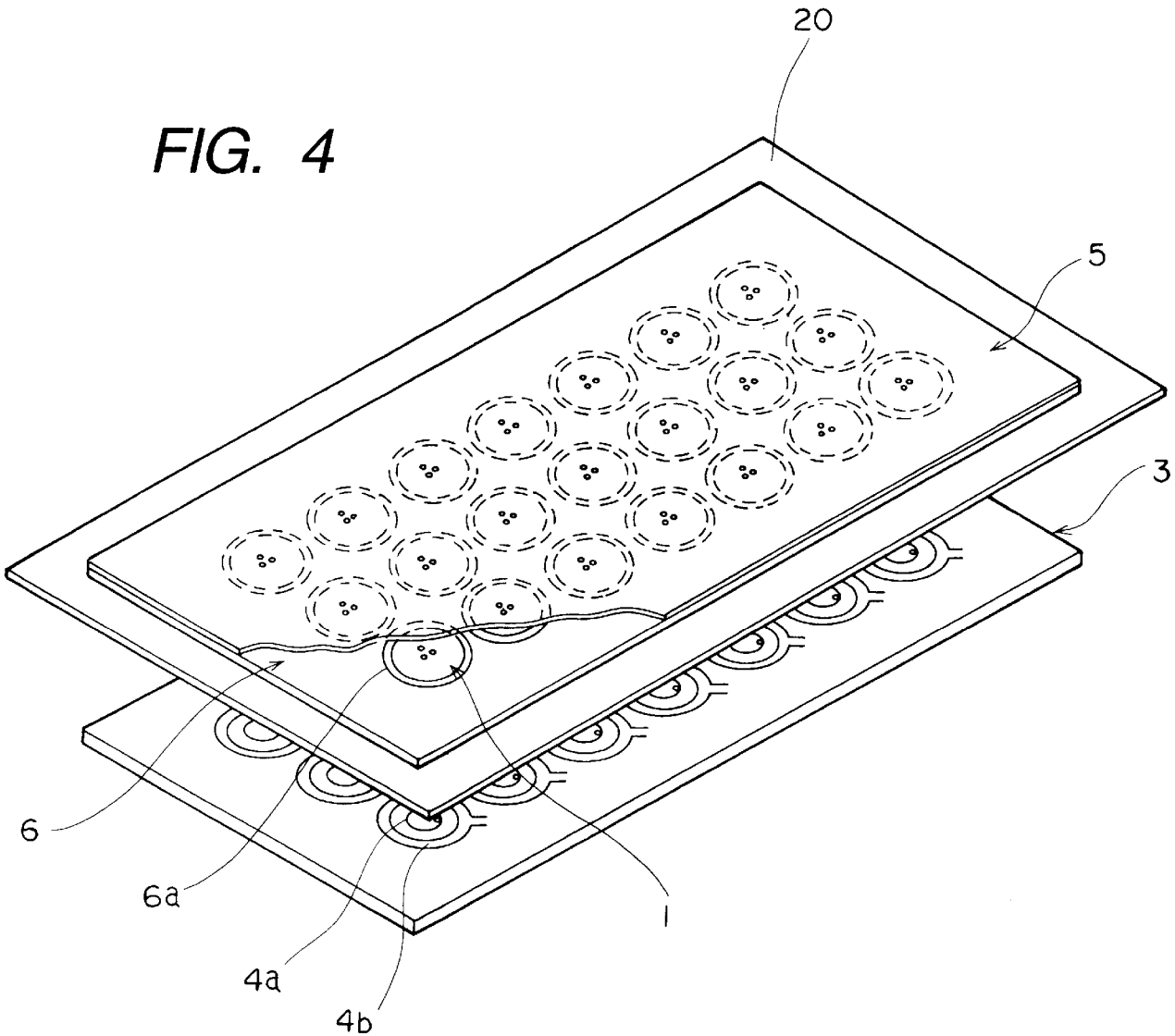
FIG. 4 is a sectional view showing a sheet-shaped switch device using the movable contact embodying the invention.
Figure 5:
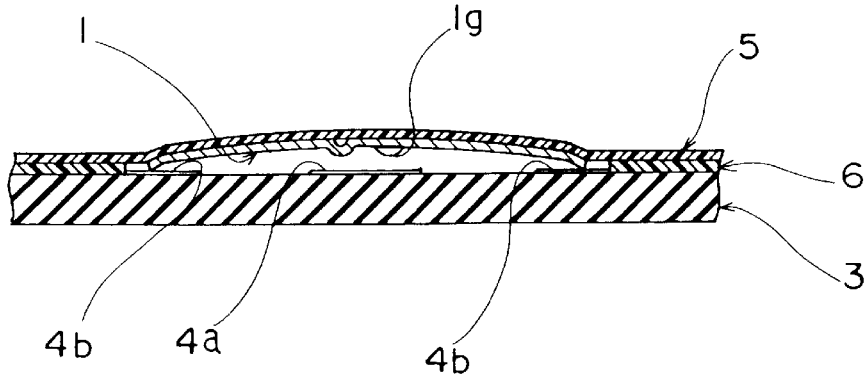
FIG. 5 is a sectional view of the essential part illustrating the sheet-shaped switch device using the movable contact embodying the invention.

FIG. 4 and FIG. 5 illustrate the structure of a sheet-shaped switch device using the movable contact 1.

In the drawings, a circuit board 3 is formed of a laminate of phenol resin or the like, and pluralities of central fixed contacts 4*a* and peripheral fixed contacts 4*b*, consisting of electroconductive copper foils or the like, are arranged over the surface of this circuit board 3.

An insulating sheet 5 is formed of an insulating film, and its lower face is fully covered with an adhesive layer, to which the dome 1*b* of the movable contact 1 is stuck to integrate the movable contact 1 with the insulating sheet 5.

A spacer 6 is also formed of an insulating film, and its lower face is also covered with an adhesive layer. At its center are provided a plurality of accommodating holes 6*a* for accommodating the movable contact 1.

The spacer 6 is stuck to the lower face of the insulating sheet 5, and the back face of the movable contact 1 stuck to the insulating sheet 5 is covered with a protective sheet 20. This protective sheet 20 consists of a film whose face opposite the adhesive layer on the lower face of the spacer 6 is peelably coated, and these elements are stacked to form a sheet with the contact plate.

A sheet-shaped switch device is formed by peeling the protective sheet 20 from this sheet with the contact plate and sticking the insulating sheet 5 and the spacer 6 to the circuit board 3 so that the movable contact 1 is placed opposite the central fixed contact 4*a* and the peripheral fixed contact 4*b*.

Then the movable contact 1 is in such a state that the dome 1*b* is separate from but opposite the central fixed contact 4*a* and the outer peripheral end 1*e* of the skirt 1*a* is in contact with the peripheral fixed contact 4*b* all the time.

In this case, in the movable contact 1 are formed a plurality of projections 1*g* (three in this embodiment) scattered in the contact 1*f*, which is the inner face of the top of the dome 1*b*. By providing the contact 1*f* with the projections 1*g* in this way, the contact of the contact 1*f* can be stabilized even if dust or the like invades the contact 1*f*, resulting in improved dustproofness. Incidentally, while even a single projection 1*g* would be effective, in other embodiments a plurality of projections would be even more effective.

In this embodiment, if the inner face of the movable contact 1 is provided with the projections 1*g*, a greater distance (the shifted quantity) can be secured between the projections 1*g* and the central fixed contact 4*a*, resulting in a crisp click feeling.

Incidentally, although the spacer 6 for accommodating the movable contact 1 is used in the foregoing embodiment, the configuration is not limited to this, but the spacer 6 can as well be dispensed with to have the insulating sheet 5 directly hold the movable contact 1.

Figure 6:
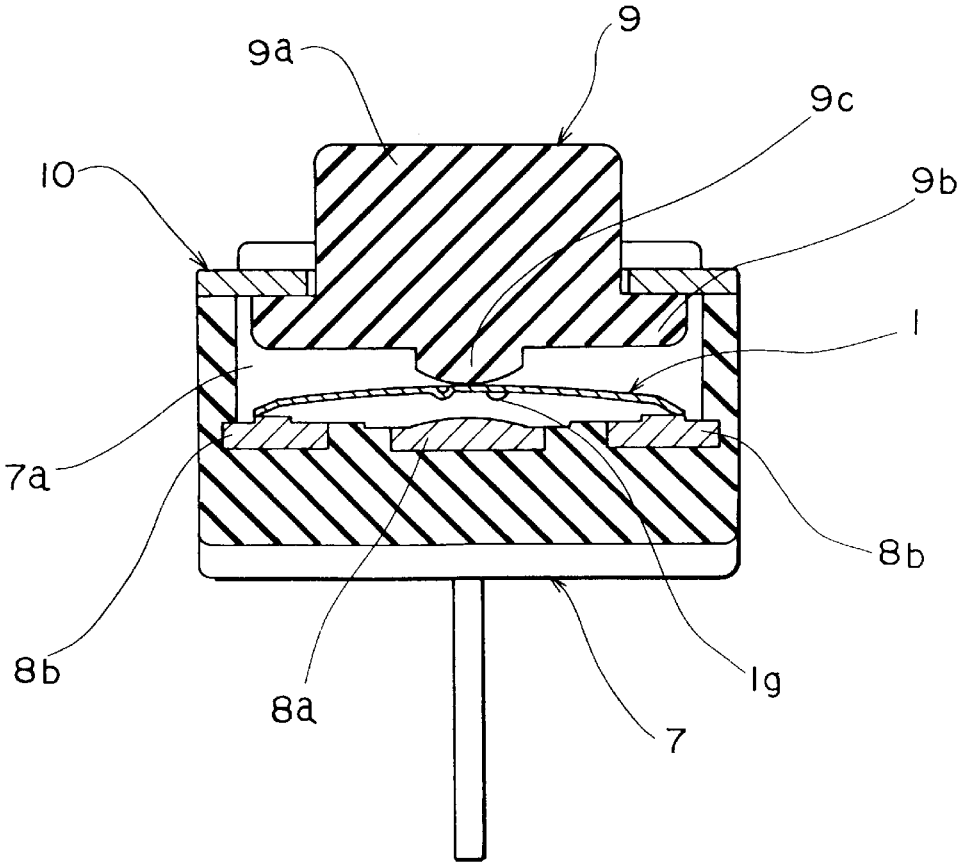
FIG. 6 is an exploded perspective view of a switch device based on an insulating resin-made housing using the movable contact embodying the invention.
Figure 7:
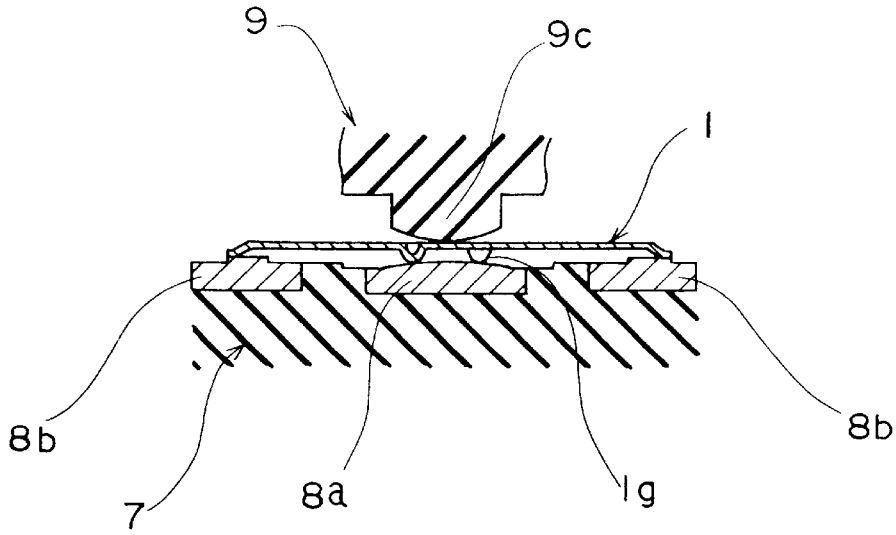
FIG. 7 is a sectional view of the essential part illustrating the switch device based on the insulating resin-made housing using the movable contact embodying the invention.
Figure 8:
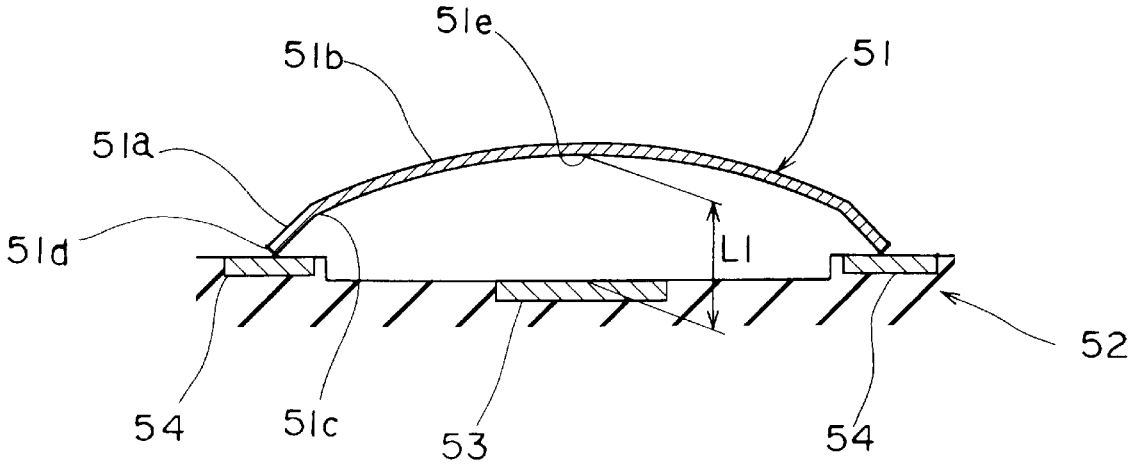
FIG. 8 PRIOR ART
FIG. 8 is a sectional view showing an example of the relationship between a movable contact and a fixed contact according to the prior art.

FIG. 6 and FIG. 7 illustrate the structure of a switch device based on an insulating resin-made housing using the movable contact 1.

In the drawing, a housing 7 is formed of an insulator, such as synthetic resin, in a box shape with an opening in the top face. On the inner bottom face of an accommodating section 7*a* formed in the opening in this housing 7 are arranged a central fixed contact 8*a* and a peripheral fixed contact 8*b* consisting of electroconductive metallic plates.

Over the central fixed contact 8*a* and the peripheral fixed contact 8*b* is formed the movable contact 1 opposite them. In this case, the dome 1*b* is separate from but opposite the central fixed contact 8*a* and the outer peripheral end 1*e* of the skirt 1*a* is in contact with the peripheral fixed contact 8*b* all the time.

A stem 9, similarly formed of an insulator such as synthetic resin, is provided with a suppressive manipulating part 9*a* protruding from the opening in the housing 7, a flange 9*b* and an operating projection 9*c* for suppressing the dome 1*b* of the movable contact 1.

A cover 10, formed of a planar metallic plate or the like, covers the opening in the housing 7, and prevents the stem 9 from springing out by keeping the flange 9*b* of the stem 9 in contact with the inner face of the cover 10.

By inserting the movable contact 1 and the stem 9 into the opening in the housing 7, covering the opening in the housing 7 with the cover 10 and fixing it by caulking or otherwise, the switch device based on the insulating resin-made housing is formed. In this case, too, the movable contact 1 comprises a plurality of projections 1*g* (three in this embodiment) scattered in the contact 1*f*, which is the inner face of the top of the dome 1*b*, resulting in improved dustproofness.

As heretofore described, the contact plate according to the present invention consists of a disc formed into a dome shape by cupping the center of a thin metallic sheet in one direction, provided with a skirt rising from the outer circumference of this disc toward the center of the disc, and a dome which is continuous from this skirt and can be repetitively inverted, the connecting part between the skirt and the dome being formed in multiple steps via a plurality of bent portions. Accordingly it is possible to generally reduce the angle formed by one of these bent portions with the dome, with the result that the point where the reaction force of the tactile sensation curve reaches its zero never becomes negative and the failure of the movable contact to automatically return to its original position can be prevented. Moreover, the shifted quantity after the inversion of the movable contact can be set to a greater value, resulting in a crispy click feeling.

Also, since projections are formed on the inner face of the dome which come in contact with the fixed contact, the contacting of the contact can be stabilized even if dust or the like invades the contact, resulting in improved dustproofness.

Also, the external face of the dome of the contact plate is stuck to the adhesive back face layer of an insulating sheet, and the contact plate and the lower face of the insulating sheet are covered with a peelable protective sheet to provide a sheet with the contact plate, with the result that fitting to a planar circuit board is facilitated and the protective sheet can prevent dust from sticking to the contact part during the handling.

Also, since a spacer sheet having an accommodating hole for accommodating the contact plate is provided between the insulating sheet and the protective sheet, the contact plate can be securely fixed in a prescribed position of the insulating sheet.

Also, after peeling the protective sheet, the sheet with the contact plate may be stuck to the circuit board by the adhesive layer of the insulating sheet to facilitate formation of a sheet shaped switch device. Since the circuit board, having a plurality of fixed contacts, is thereby arranged so that the fixed contact is opposite the contact plate, the sheet-shaped switch device gives a crispy click feeling and automatically returns without failure to the original position after being inverted.

Also, since a switch device has the contact plate and an accommodating section, whose inner bottom face is provided with a housing over which a fixed contact is arranged and a suppressing member liftably snapped into the accommodating section, and the contact plate is arranged opposite the fixed contact to be suppressible by the suppressing member, a switch device based on an insulating resin-made housing which automatically without fail returns to the original position and gives a crispy click feeling can be easily obtained.

What is claimed is:

1. A contact plate consisting of a disc formed into a dome shape by cupping a center of a thin metallic sheet in one direction, provided with a skirt rising at a prescribed angle from an outer circumference of the disc toward a center of the disc, and a dome which is continuous from the skirt and can be repetitively inverted, a connecting part between the skirt and the dome being formed in multiple steps via a plurality of bent portions.

2. The contact plate according to claim 1, wherein a projection in contact with a fixed contact is formed on an inner face of the dome.

3. A sheet with the contact plate, wherein an external face of the dome of the contact plate according to claim 1 is stuck to an adhesive back face layer of an insulating sheet, and wherein the contact plate and a lower face of the insulating sheet are covered with a peelable protective sheet.

4. A sheet with the contact plate according to claim 3, wherein a projection in contact with a fixed contact is formed on an inner face of the dome of the contact plate.

5. A sheet with the contact plate according to claim 3, wherein a spacer sheet having an accommodating hole for accommodating the contact plate is provided between the insulating sheet and the protective sheet.

6. A switch device, wherein the protective sheet of the sheet with the contact plate according to claim 3 is peeled, and wherein the sheet with the contact plate after peeling is stuck to a circuit board, over which a plurality of fixed contacts are arranged, by the adhesive layer of the insulating sheet so that the contact plate is opposite the fixed contacts.

7. A switch device having the contact plate according to claim 1 and an accommodating section, whose inner bottom face is provided with a housing over which a fixed contact is arranged and a suppressing member liftably snapped into the accommodating section, wherein the contact plate is arranged opposite the fixed contact to be suppressible by the suppressing member.

8. The switch device according to claim 7, wherein a projection in contact with a fixed contact is formed on an inner face of the dome of the contact plate.

* * * * *